United States Patent [19]

Duhomez et al.

[11] 4,413,815

[45] Nov. 8, 1983

[54] DEVICE FOR BLOWING SWIRLING GAS INTO A METAL REFINERY CONVERTER

[75] Inventors: Roger Duhomez; Guy Quenton, both of Dunkerque, France

[73] Assignee: Compagnie Francaise des Aciers Speciaux, Paris, France

[21] Appl. No.: 370,652

[22] Filed: Apr. 21, 1982

[30] Foreign Application Priority Data

Apr. 24, 1981 [FR] France ..... 81 08188

[51] Int. Cl.[3] ..... C21B 7/16

[52] U.S. Cl. ..... 266/265; 75/59; 75/60; 266/266

[58] Field of Search ..... 266/265–270; 75/59, 60

[56] References Cited

U.S. PATENT DOCUMENTS 3,901,445 8/1975 Chang ..... 75/60

4,298,192 11/1981 Barbakadze ..... 266/265

*Primary Examiner*—P. D. Rosenberg

*Attorney, Agent, or Firm*—Pollock, Vande Sande & Priddy

[57] ABSTRACT

A device for swirling, through the bottom of a converter for refining liquid metals, by oxygen lance blowing, consisting of a set of single tube tuyeres, located throughout the entire thickness of the refractory coating of the converter and wearing away with the latter. The tube constituting each of the tuyeres is flattened along the whole consumable length (1*b*) of the tuyere, the width of the internal cross-section for the passage of the gas in the flattened tube (1*b*) is, at most, equal to 1.0 mm and, preferably, approximately 0.5 mm, the head (1*a*) of each of said tubes, generally cylindrical, passes through a steel plate (5) to which it is brazed, and the steel plate (5) constitutes one of the walls of a distribution chamber (6) between the swirling gas tuyeres, supplied with gas through a duct (7), the chamber (6) being fixed by means of the plate (5) to the exterior surface of the sheathing (8) of the converter.

7 Claims, 5 Drawing Figures

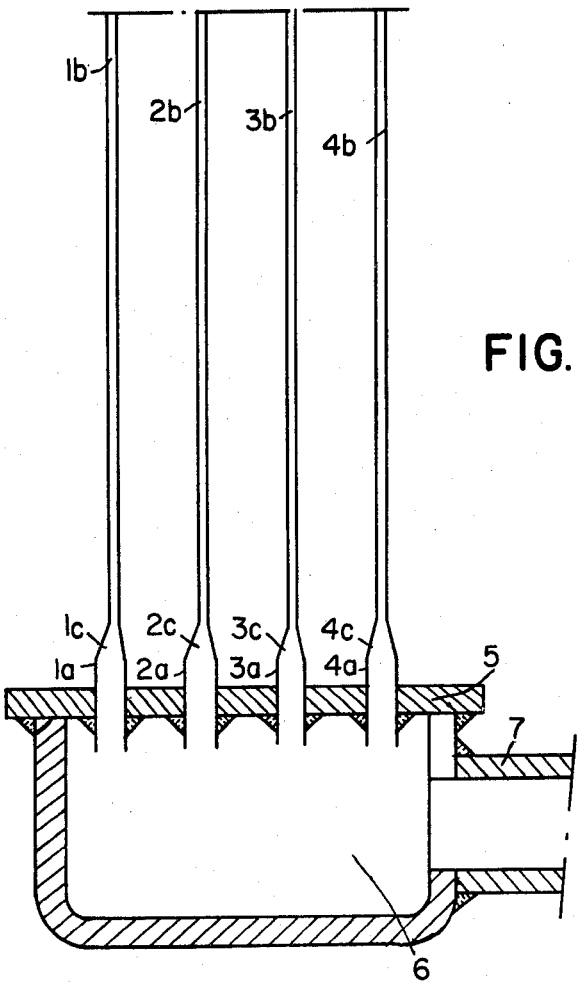
FIG. 1
FIG. 2
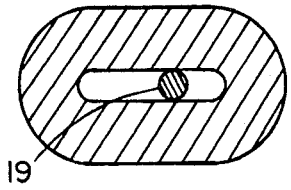
FIG. 3
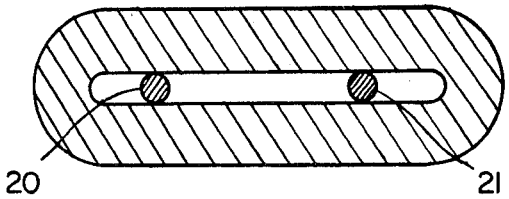

DEVICE FOR BLOWING SWIRLING GAS INTO A METAL REFINERY CONVERTER

FIELD OF THE INVENTION

The present invention relates to a tuyere device for blowing swirling gas into a converter for the lance refining of liquid metals, for example a steelworks converter.

Such a swirling gas can be a neutral gas, e.g., nitrogen or argon, or an oxidizing and cooling gas, such as steam or carbon dioxide, or a low-oxidizing gas, e.g., ordinary air, but excluding strongly oxidizing gases, such as pure oxygen, which would cause much too rapid wear of the tuyeres according to the invention.

BACKGROUND

When operating the refining of steel by blowing pure oxygen from the top downwards by means of a lance, it is advantageous to be able to assure swirling of the metal bath and of the slag, which is effected by blowing a swirling gas at a low flow rate from the bottom upwards through the base of the converter.

Different systems are known for blowing a swirling gas at a low flow rate through the bottom of a converter.

Some use porous refractories, the open and, possibly, orientated porosity of which enables gas to be channelled under pressure through the refractory mass.

Others use permeable elements, consisting of compact refractory bricks, the joints between bricks forming very narrow passages which, nevertheless, are permeable to gases under pressure. These permeable passages are produced either by a designed assembly of metal plates surrounding each of the bricks or by moving together bricks, which have been previously sawn and to both sides of which very thin metal wires have been attached.

However, all these known systems show significant and variable rates of wear on the refractories. For the rates of wear to be acceptable in the industrial application of these known systems, on the one hand, the temperature of the metal bath has to remain moderate, for example always below 1660° C., and, on the other hand, the working methods have to be such that the permeable elements are permanently covered with a deposit of magnesia-enriched slag, by a so-called "buttering" technique. It follows from this that, below 1660° C., reliability of the permeable elements is not necessarily secured if the deposit of magnesia slag is insufficient and that, above 1660° C., the permeable elements can hardly be used, because this deposit of magnesia slag is formed with even greater difficulty.

SUMMARY OF THE INVENTION

The object of the present invention is to make it possible, in good conditions of industrial application, for the blowing of swirling gas to take place through the bottom of a converter and, in case of need, even through its side coating, and this even if the temperature of the metal bath to be refined considerably exceeds 1660° C. and even if the deposit of basic slag on the blowing device is thin or non-existent.

To this end, the subject of the present invention is a device for blowing swirling gas through the bottom or the wall of a converter for refining liquid metals, consisting of a set of single tube tuyeres, located throughout the entire thickness of the compact refractory coating of the converter and wearing away with the latter. The tube constituting each of the tuyeres is flattened along the whole consumable length of the tuyere, the width of the internal cross-section for the passage of the gas in the flattened tube being, at most, equal to one millimeter and, preferably, approximately 0.5 mm. The base of each of said tubes, generally cylindrical, passes through a steel plate, to which it is brazed, and said steel plate constitutes one of the walls of a distribution chamber between the swirling gas tuyeres, supplied with this gas through a duct, said chamber being fixed by means of said plate to the exterior surface of the sheathing of the converter.

According to a particular aspect of the invention, each of the tuyeres contains at least one longitudinal metal wire the diameter of which covers the exact width of the flattened part of the tube, which constitutes the tuyere.

According to another particular aspect of the invention, the steel plate, through which all the tubes of the same set of tuyeres pass, has applied to it a coat of tamped, compact refractory material, representing a safety coat, through which said tubes go, following different directions from one another behind said plate.

According to another particular aspect of the invention, the bricks of the erosive layer of the refractory coating, which overlays the safety coat, contain each tube placed in a saw-cut, worked along the whole length of the corresponding brick.

According to another particular aspect of the invention, the tuyere set is arranged in a straight line and several individual bricks in the same range of the erosive coating can each contain on their edge one of these tuyeres or even two.

According to another particular aspect of the present invention, the tuyere set is arranged along several adjacent and parallel straight lines and, following these straight lines, several individual bricks of the same range of the erosive coating can each contain on their edge one or two of these tuyeres.

One of the main advantages of the invention is that the installation of this device is easy, easier than that of the known permeable elements. Thus, the gas distribution chamber is placed on the outside of the sheathing of the converter; in the depth of the refractory safety coat, the small tubes of the same set are spread out in umbrella fashion and diverge from one another; in the erosive refractory coat, each tube is housed in a saw-cut, worked along the length of the brick. This installation is easier than that of porous plugs or permeable elements.

An additional advantage of the device according to the invention is that the principle of assembling the bricks which make up the base or the wall of the refinery container is not affected as a result of the installation of the tuyeres according to the invention.

Another advantage of the invention is greater safety. In fact, in the known devices, behind a porous plug or a permeable element, placed in the erosive coat, a cavity of, e.g., 30 mm in diameter has to be left in the safety coat, if it is desired to pass a tube of 27 mm through for supplying the porous plug or the permeable element with swirling gas. This cavity presents a certain risk in case of excessive wear or of perforation of the permeable element.

By way of contrast, with a set of tuyeres according to the invention, the safety coat consists, in the zone of the tuyere set, of a composition of dolomite or of magnesia, tarred, tamped and compact, through which the network of thin tubes passes, greatly limiting the risk of infiltration of liquid steel. In fact, the refractory safety coat is penetrated below the swirling gas distribution chamber between the different tuyeres. In other words, an individual circuit of each tuyere and not a collective supply system passes through the safety coat. This arrangement greatly limits the seriousness of the consequences of possible metal infiltration into the safety coat.

In short, the essential advantage of the blowing device according to the invention is to provide a better resistance of the bottom of the converter to wear in the course of the refining of the bath, and this without the need of producing a permanent protective coat of magnesia slag, deposited on said bottom.

BRIEF DESCRIPTION OF THE DRAWINGS

For a clear understanding of the invention, two embodiments of the device according to the invention in the base of a steelworks converter with oxygen lance blowing will be described below by way of non-limiting examples.

FIG. 1 is a vertical section of the device in a four-tuyere row.

FIG. 2 is a transverse section of a flattened tube of the first embodiment.

FIG. 3 is a transverse section of a flattened tube of the second embodiment.

DETAILED DESCRIPTION

Figure 4:
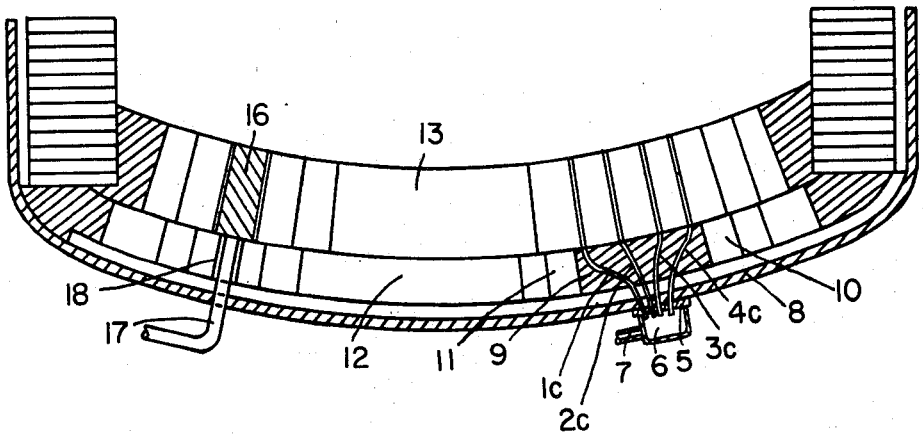
FIG. 4 is a vertical section of the base of the converter, equipped with a set of tuyeres according to the invention on its right hand side and, by way of explanatory comparison, equipped with a porous plug of the known type on its left hand side.

FIG. 1 shows four tuyeres 1, 2, 3, 4, the heads 1*a*, 2*a*, 3*a*, 4*a* of which consist of cylindrical copper tubes, the consumable lengths 1*b*, 2*b*, 3*b*, 4*b* of which consists of the same tubes as their heads, but flattened according to FIG. 2 or 3, the intermediate parts 1*c*, 2*c*, 3*c*, 4*c* serving to connect the cylindrical parts with the flattened parts.

The cylindrical head of each of these four tuyeres is brazed on to the steel plate 5 which makes up one of the walls of the distribution chamber 6 supplied with swirling gas through the duct 7.

In the first embodiment, the heads of the tuyeres, at a, are tubes of 2 mm internal diameter and 4 mm external diameter. The transverse section of the flattened part, which can be seen in 10-fold magnification in FIG. 2, has an internal width of 0.5 mm, an internal length of 2.5 mm, an external width of 2.5 mm and an external length of 4.5 mm.

A piano wire of 0.5 mm diameter, which is contained in each tuyere over its whole length and the section of which can be seen as 19 in FIG. 2, accurately defines the internal width of the flattened tube at 0.5 mm.

In this first embodiment, the chamber 6 feeds ten tuyeres, only 4 of which are shown in the drawing of FIG. 1, another three being located in front of the drawing of the figure and another three behind that drawing. All are brazed onto the plate 5.

In the second embodiment described here by way of example, the heads of the tuyeres, at a, are tubes of 4 mm internal diameter and 6 mm external diameter. The transverse section of the flattened part, which can be seen in 10-fold magnification in FIG. 3, has an internal width of 0.5 mm, an internal length of 6 mm, an external width of 2.5 mm and an external length of 8 mm. Two piano wires, each 0.5 mm in diameter, which are contained in each tuyere over its whole length and the sections of which can be seen as 20 and 21 in FIG. 3, accurately define the internal width of the flattened tube at 0.5 mm. In this second embodiment, the chamber 6 feeds 14 tuyeres, only 4 of which are shown in the drawing of FIG. 1, and all of which are brazed on to the plate 5.

In the grading measurements in the cold, the flow rates, observed as a function of the inlet pressure of the nitrogen blown in, are mentioned in the following table for each of the two above embodiments.

TABLE

| Flow rate characteristics in the cold, in $Nm^3$/min. of nitrogen, as a function of blowing pressure | | | | | | |
|---|---|---|---|---|---|---|
| Absolute pressure, in bars | 2 | 3 | 5 | 7 | 9 | 13 |
| Embodiment 1 - 10 tubes: 2.5 × 0.5 | 0 | 0 | 0.1 | 0.35 | 0.5 | 0.8 |
| Embodiment 2 - 14 tubes: 6 × 0.5 | 0.4 | 0.8 | 1.4 | 2 | not measured | |

Thus, for a total passage cross-section of the embodiment 2, which is 3.36 times larger than the cross-section of the embodiment 1, the flow rates under 5 bars are 14 times higher and, under 7 bars, 5.7 times higher.

In the hot, in situ in the steelworks converter in the course of blowing, a flow rate of 0.35 $Nm^3$/min. was measured under 9 bars with the embodiment 1,—instead of 0.50 $Nm^3$/min. in the cold, and a flow rate of 1.4 $Nm^3$/min. under 7 bars with the embodiment 2, instead of 2 $Nm^3$/min. in the cold.

Figure 5:
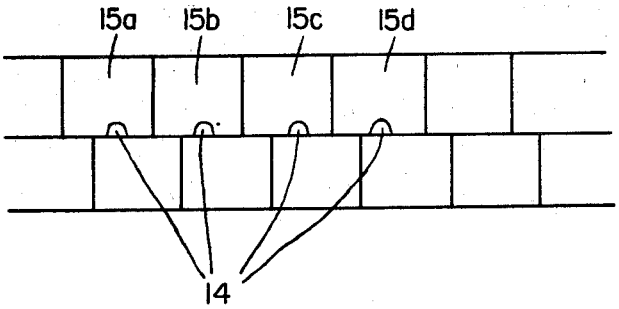
FIG. 5 is a horizontal section of a row of bricks of the erosive coat of the refractory base, each containing a groove for the insertion of a flattened tube.

The installation of a device according to the invention in the bottom of the steelworks converter, under consideration in this example, can be seen in FIGS. 4 and 5.

The distribution chamber 6 is fixed by means of the plate 5 to the sheathing 8 of the steelworks converter. In the drawing of FIG. 4, the right-hand side of which corresponds to FIG. 1,—the four flattened tubes 1*c*, 2*c*, 3*c*, 4*c* diverge as from the plate 5 into a coat 9 of tarred, tamped and compact magnesia, located between two bricks 10 and 11 of the safety coating 12 of the refractory base.

Then, for passing through the erosive coat 13, each of the tubes is housed in a saw-cut 14, which can be seen in FIG. 5 and which is worked along the whole length of each of the corresponding bricks 15*a*, 15*b*, 15*c*, 15*d*, this length being equal to 500 mm.

Evidently, the tuyeres can be arranged along several straight lines, parallel to one another, each of the straight lines being similar and parallel to that of FIG. 5.

By way of comparison, FIG. 4 also shows, in its left-hand part, a porous plug 16 of known type, taking up the whole height of the erosive coat 13 and fed by a tube 17 of 27 mm external diameter, which passes through a cavity 18 in the safety coat 12, this cavity 18 having a diameter of approximately 30 mm. Thus, between the tube 17 and the wall of the cavity 18 there is a free space, into which liquid steel could infiltrate in case of complete wear of the porous plug 16. This is a risk that does not exist with the blowing device according to the invention.

Improvements of details can be visualised or equivalent means used without going beyond the scope of the invention. Thus, a plurality of elements similar to those of the described embodiment can be placed in the same refractory base.

We claim:

1. A device for blowing swirling gas through the compact refractory coating of the bottom wall of a converter for refining liquid metals and having a compact refractory coating, consisting of a set of single tube tuyeres, located throughout the entire thickness of said compact refractory coating and wearing away with said coating, the tube constituting each of the said tuyeres being flattened along the whole consumable length (1*b*) of said tuyere, the width of the internal cross-section for the passage of the gas in the flattened tube (1*b*) being, at most, equal to 1.0 mm, the head (1*a*) of each of said tubes, generally cylindrical, passing through a steel plate (5), to which it is brazed, and said steel plate (5) constituting one of the walls of a distribution chamber (6) between said swirling gas tuyeres, supplied with said gas through a duct (7), said chamber (6) being fixed by means of said plate (5) to the exterior surface of the sheathing (8) of said converter.

2. A blowing device according to claim 1, wherein the width of said internal cross-section for the passage of the swirling gas in the flattened tube (1*b*) of each tuyere is of the order of 0.5 mm.

3. A blowing device according to either one of claims 1 and 2, wherein the tube constituting each tuyere contains at least one longitudinal metal wire (19), the diameter of which covers the exact width of the flattened part of said tube.

4. A blowing device according to any one of claims 1 to 3, wherein said steel plate (5), through which all the tubes (1*c*), (2*c*), (3*c*), (4*c*) of the same set of tuyeres pass, has a coat of tamped, compact refractory material, representing a safety coat (12), through which said tubes (1*c*) pass, following different directions from one another behind said plate.

5. A blowing device according to any one of claims 1 to 4, including an erosive layer (13) of said refractory coating, which overlays the safety coat (12), said erosive layer comprising bricks each containing a flattened tube (1*b*) placed in a saw-cut (14) along the whole length of the corresponding brick.

6. A blowing device according to claim 1 or 2, wherein said tuyere set is arranged in a straight line and each of said tuyeres corresponds to a particular brick of the same range of the erosive coating.

7. A blowing device according to claim 1 or 2, wherein said tuyere set is arranged along several adjacent and parallel straight lines and, upon following these straight lines, several individual bricks of the same range of the erosive coating can each contain on their edges at least one of these tuyeres.

* * * * *